United States Patent [19]

Adolfsson

[11] Patent Number: 4,588,536

[45] Date of Patent: May 13, 1986

[54] APPARATUS FOR SUPPLING GAS TO A LIQUID IN A CONTAINER

[75] Inventor: Bengt O. Adolfsson, Stockholm, Sweden

[73] Assignee: Kommanditbolaget Aldolf, Västerås, Sweden

[21] Appl. No.: 598,148

[22] PCT Filed: Jun. 23, 1983

[86] PCT No.: PCT/SE83/00261

§ 371 Date: Mar. 9, 1984

§ 102(e) Date: Mar. 9, 1984

[87] PCT Pub. No.: WO84/00352

PCT Pub. Date: Feb. 2, 1984

[30] Foreign Application Priority Data

Jul. 16, 1982 [SE] Sweden ..... 82043688

[51] Int. Cl.[4] ..... B67D 1/04

[52] U.S. Cl. ..... 261/121 R; 261/DIG. 7; 99/323.1

[58] Field of Search ..... 261/DIG. 7, 50 R, 66, 261/121 R; 99/323.1, 323.2; 137/101.25, 101.27; 222/556

[56] References Cited

U.S. PATENT DOCUMENTS

| | | | |
|---|---|---|---|
| 2,647,734 | 8/1953 | Nicholas | 261/DIG. 7 |
| 3,248,098 | 4/1966 | Cornelius | 261/DIG. 7 |
| 3,552,726 | 1/1971 | Kraft | 261/DIG. 7 |
| 3,618,905 | 11/1971 | Primus | 261/50 R |
| 3,851,797 | 12/1974 | Jacobs | 261/DIG. 7 |
| 4,298,551 | 11/1981 | Adolfsson et al. | 261/DIG. 7 |
| 4,509,569 | 4/1985 | Adolfsson | 141/360 |

FOREIGN PATENT DOCUMENTS

| | | | |
|---|---|---|---|
| 0222550 | 1/1959 | Australia | 261/DIG. 7 |
| 2093359 | 9/1982 | United Kingdom | 261/DIG. 7 |

*Primary Examiner*—Joseph J. Rolla
*Assistant Examiner*—Louise S. Heim
*Attorney, Agent, or Firm*—Sughrue, Mion, Zinn, Macpeak and Seas

[57] ABSTRACT

An apparatus for supplying gas to a liquid in a container (4) having a gas conduit (5) discharging thereinto, the apparatus being particularly intended for preparing aerated beverages on a small scale. In the upper part of the container there is provided a filling orifice (6). To simplify the use of the apparatus and to prevent mistakes, the orifice (6) is provided with a closure means (27) which is arranged to close the orifice automatically in conjunction with charging gas to the container (4). In this respect, the closing movement of the closing means is preferably arranged to be initiated by the stream of gas entering the container. To provide a safer and more positive apparatus, the apparatus is suitably designed so that the closing of the closure means (27) can only be initiated when the container (4) is filled with liquid to a given level.

12 Claims, 10 Drawing Figures

APPARATUS FOR SUPPLING GAS TO A LIQUID IN A CONTAINER

TECHNICAL FIELD

The present invention relates to apparatus for supplying gas to a liquid in a container having a gas conduit discharging thereinto, particularly for preparing aerated beverages. Arranged in the upper part of the container is an orifice through which liquid is introduced into the container.

BACKGROUND ART

For the purpose of preparing aerated beverages on a small scale, for example in the home, apparatus are known by means of which carbon dioxide can be supplied to water in a bottle, the water then being flavoured with a flavouring substance. In the preparation of such beverages, it is necessary first to fill a bottle with water up to a given level, and then to hold the bottle firmly gripped in the apparatus while supplying carbon dioxide to the water. The bottle is then removed from the apparatus and the flavouring substance added. The beverage is then ready to be poured into a drinking glass or like vessel.

In addition to being relatively complicated, since among other things it requires the use of a separate bottle whose shape and size are adapated to the apparatus in question, the aforedescribed procedure for preparing aerated beverages is also encumbered with other problems and safety risks. Among other things, it is difficult to obtain a good seal when using standard bottles, since these bottles can vary greatly in height. In addition, risks are involved when subjecting return bottles to pressure, since in addition to uneven manufacturing quality the bottles may have been damaged during previous use or in transportation. Further, in the case of known apparatus the bottle can be pressurized without having been filled with liquid, which presents a risk of serious injury should the bottle explode. It is also possible with known apparatus to overfill the bottle with liquid, rendering it impossible to supply sufficient carbon dioxide to the liquid. In order to aearate a liquid effectively in a container, it is necessary to provide above the surface of the liquid a space in which the gas can be compressed.

It has also been proposed to introduce carbon dioxide into a liquid enclosed in a container fixed in an apparatus, and to pour the aerated liquid directly from the container into a glass. The use of this container is also relatively complicated, however, and in some respects the arrangement is unsafe. For example, it is possible with such known apparatus to pressurize an empty container. Furthermore, it is possible to begin to pour liquid from the container while the container is still under high pressure.

Apparatus of the kind mentioned in the introduction and by means of which the aforementioned disadvantages are eliminated is described in Applicant's U.S. Pat. No. 4,509,569.

OBJECT OF THE INVENTION

The prime object of the present invention is to provide a further development of the apparatus described in the aforesaid Patent, in which the filling orifice of the container is automatically closed in a ready and reliable fashion, when so desired.

BRIEF SUMMARY OF THE INVENTION

In this respect, an apparatus according to the invention is characterized in that the filling orifice of the container is provided with a closure means which is arranged to close the orifice automatically in conjunction with supplying gas to the container. Among other things, such an embodiment obviates the need for additional manual handling of the container when supplying carbon dioxide thereto, such additional manual handling readily being forgotten. Furthermore, with such an embodiment the filling orifice is normally open, which facilitates both filling of the container and the pouring of liquid therefrom.

In a preferred embodiment, movement of the closure means to its closing position is initiated by the gas stream. In this respect, the closure means is suitably in connection with a means which is located in front of the discharge orifice of the gas conduit and which is arranged to be acted upon by the exiting gas stream. The closure means is preferably pivotally suspended and arranged to be caused, subsequent to iniatation of said closing movement by means of the gas stream, to sealingly close the filling orifice in response to the increasing gas pressure in the container.

With an embodiment such as this, the sealing effect will improve with increasing pressure in the container. Moreover, the closure means will open the filling orifice automatically as soon as the container has been purged of pressure, which ensures troublefree filling and emptying of liquid into and from said container.

In order to prevent the container from being pressurized when the liquid therein does not reach to a given lowest level, the said means located in front of the discharge orifice of the gas conduit is preferably arranged to initiate closing of said closure means, when gas is supplied to the container, only when the container is filled with liquid to a given level.

In accordance with one embodiment of the invention said means may be provided, to this end, with an opening through which the gas stream is able to pass until the opening is closed by the liquid when said liquid has reached said given level. In a further embodiment the weight of said means is such that the gas stream is unable to affect said means until the buoyancy force exerted by said liquid acts upon said means. In accordance with another embodiment, said means is mechanically latched when the container is empty, said latch being released by the action of the liquid on a body co-acting with the latching means.

The invention will now be described in more detail with reference to exemplary embodiment thereof illustrated in the accompanying drawings.

DESCRIPTION OF PREFERRED EMBODIMENTS OF THE INVENTION

Figure 1:
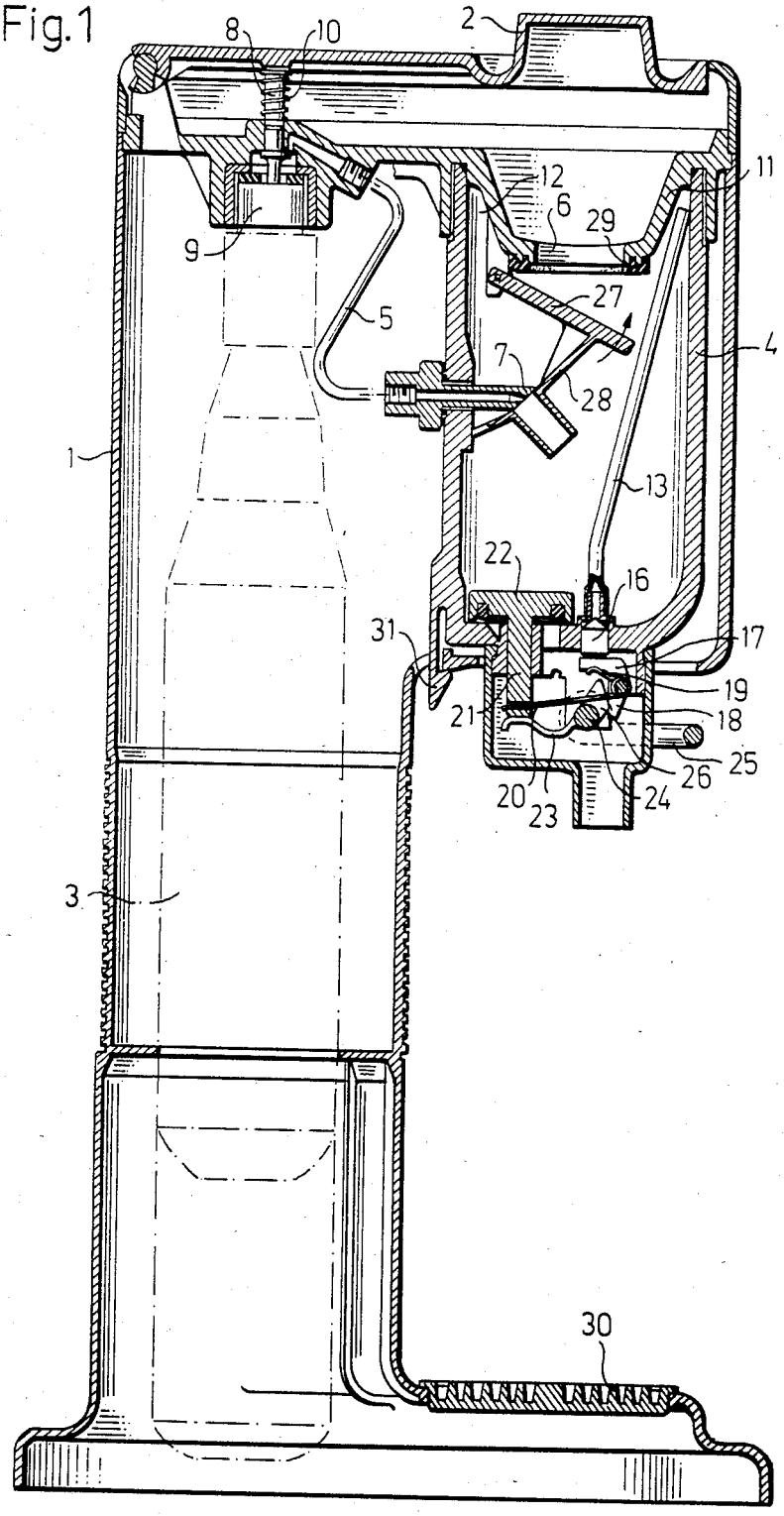
FIG. 1 is a sectional view of a beverage preparing apparatus in accordance with one embodiment of the present invention, said apparatus being shown in its rest position.

The apparatus illustrated in FIG. 1 comprises a casing 1 having pivotally mounted thereon a lid 2, which serves as an operating device. The casing embraces a gas tube 3 and a liquid container 4, which is connected to the gas tube via a pipe 5. Liquid can be introduced into the container 4 through an orifice 6. The liquid can be pressurized subsequent to the liquid reaching a level at which the nozzle 7 connected to the pipe 5 is surrounded by liquid. The liquid is pressurized by depressing the lid 2, which is, to this end, arranged to open a valve mechanism 9 connected to the gas container 3, via a peg 8. The peg 8 is embraced by a spring 10, which holds the lid in correct position when not activated.

The filling orifice 6 is located in a funnel-shape part 11, which facilitates filling of the container with water and also prevents the container 4 from being overfilled. Thus, a given volume of air 12 will always be obtained above the surface of the liquid. Extending from this air-filled space 12 is a gas-evacuating pipe 13, which leads to a combined over-pressure-and-evacuating valve 16. In the illustrated position, the valve body is pressed sealingly against the valve seat by one arm 17 of an angled lever, the other arm of which is referenced 18. The arm 17 is pressed against the valve body by one arm 19 of a spring member, said spring member having a second arm 20 which is mounted on a valve spindle 21. The arms 19 and 20 of the spring member attempt to diverge, which results in the valve spindle 16 being acted upon by an upwardly directed force and subjects valve 22 to a downwardly acting tension force. Reference numeral 23 identifies a spring tongue, which is inactive in the illustrated position. The tongue 23 is attached to a shaft 24, which can be rotated by a lever 25. The shaft 24 also carries an actuating finger 26.

The filling orifice 6 is arranged to be closed by means of a flap valve 27, which is provided immediately in front of the nozzle 7 with an actuating part 28. An O-ring 29 surrounds the orifice 6. A glass or the like can be placed on a plate 30 when dispensing a drink.

The following steps are taken when charging carbon dioxide to the water and dispensing the aerated water into a glass by means of the aforedescribed apparatus. The lid 2 is lifted and the container 4 filled with water to a level above the nozzle 7. The bottom valve 22 will be held closed by the spring arm 20. When the water reaches a selected level, the lid 2 is closed and depressed beyond the position shown in FIG. 1. This will cause the valve of the gas container 3 to open, and a stream of carbon dioxide passes out through the nozzle 7. This stream or jet of carbon dioxide strikes the actuating part 28, which initiates a closing movement of the flap valve 27. Complete closure of the flap valve is effected as a result of the increasing pressure in the container 4.

Thus, with this embodiment of the present invention no additional manual operations are required for closing the container, since the container is closed automatically in conjunction with charging carbon dioxide to the water. This embodiment also provides the advantage whereby the valve 27 is normally open and a larger water-filling orifice can be used. When filling the container with water, the water is deflected to one side by the flap valve 27, which enables air in the container 4 to readily escape therefrom, through the opposite side of the filling orifice 6.

When the pressure of carbon dioxide in the container 4 has reached a given value, the valve 16 will open against the action of the spring arm 19. This can be announced by means of an acoustic signal, indicating that no more gas shall be charged, whereupon the lid 2 is released. When tapping water from the container, the lever arm 25 is swung clockwise, which forces the actuating finger 26 to open the valve 16, at the same time as the spring tongue 23 strives to open the outlet valve 22. In this respect, the force exerted by the spring tongue 23 is adapted in relation to the surface of the bottom valve 22, so that said bottom valve will not open until the pressure in the container has fallen to a given value, in response to the opening of the valve 16. Thus, no water can be fed from the container until the pressure therein is of such a low magnitude as to enable the water to be emptied with no problem. In this respect, the flap valve 27 is also re-opened, which enables the requisite amount of air to flow into the container to obtain trouble free dispensing of the water into a glass or the like, to which the desired flavouring substance can then be added and stirred into the water.

In the illustrated embodiment the filling orifice 6 is closed in an extremely reliable and effective manner, due to the fact that the aforementioned closing movement is initiated by the jet or stream of carbon dioxide. Alternatively, the valve 27 can be arranged to close the orifice 6 solely as a result of the increasing pressure in the container 4.

The aforedescribed apparatus is extremely simple to use, and enables the gas container 3 to be readily changed, since all that is required in this respect is to release a snap-lock 31 at the bottom of the container 4, whereafter the whole of the inner unit, comprising the gas and liquid containers, can be lifted from the casing and the gas container changed. Thus, the change of gas containers can be readily effected without the use of tools. The aforedescribed apparatus is also of simple design and relatively cheap to produce.

Figure 2:
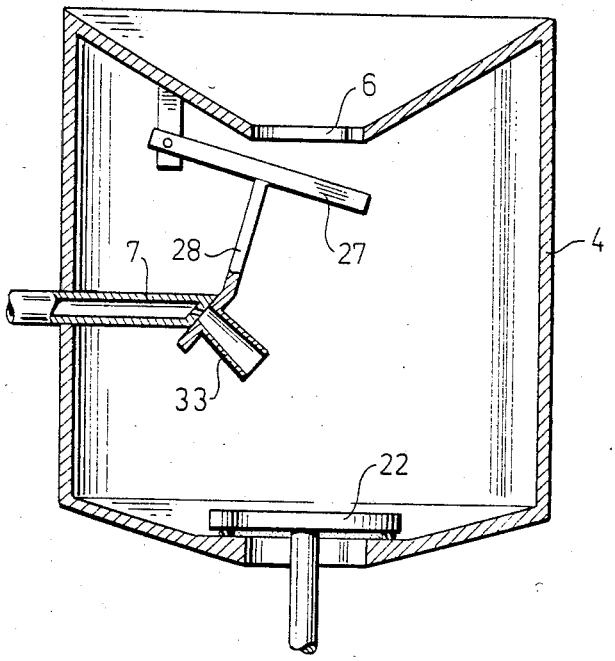
FIGS. 2–4 illustrate schematically and in section an alternative embodiment of the pressure container forming part of the apparatus illustrated in FIG. 1.

FIG. 2 illustrates schematically an alternative embodiment of the closure means arranged in the liquid container 4. For the sake of simplicity the bottom valve 22 has been illustrated schematically and the mechanism for evacuating gas and dispensing liquid from the container has not been shown in the Figure. This mechanism, however, may be identical with the mechanism illustrated in FIG. 1.

The embodiment illustrated in FIG. 2 is intended to eliminate those risks associated with the pressurizing of an empty liquid container 4.

To this end, the actuating arm 28 co-acting with the valve 27 is provided at a location opposite the orifice of nozzle 7 with an opening to which a pipe section 33 is connected, the pipe section of the illustrated embodiment being shown to diverge.

Figure 3:
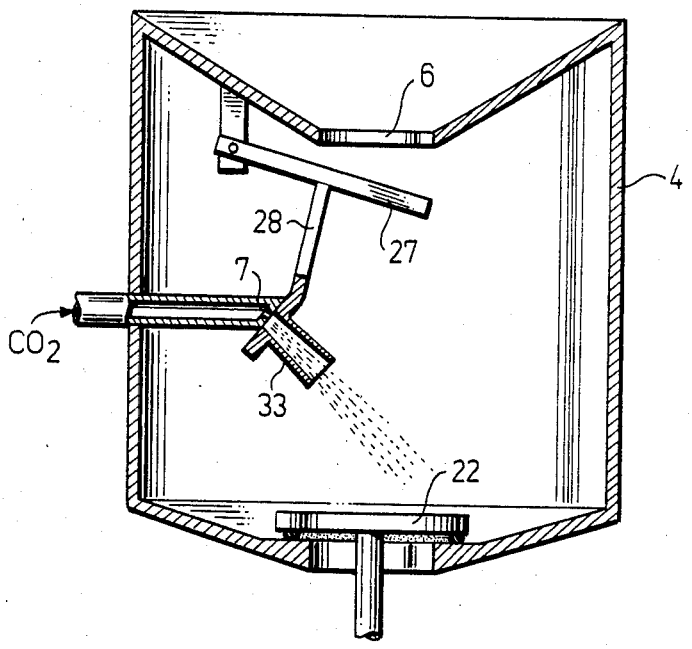

If an attempt is made to pressurize the container 4 before the level of liquid has reached the nozzle 7, the gas jet or stream will pass freely through the pipe 33 and will not initiate the aforementioned closing movement of the valve 27. This is illustrated in FIG. 3.

Figure 4:
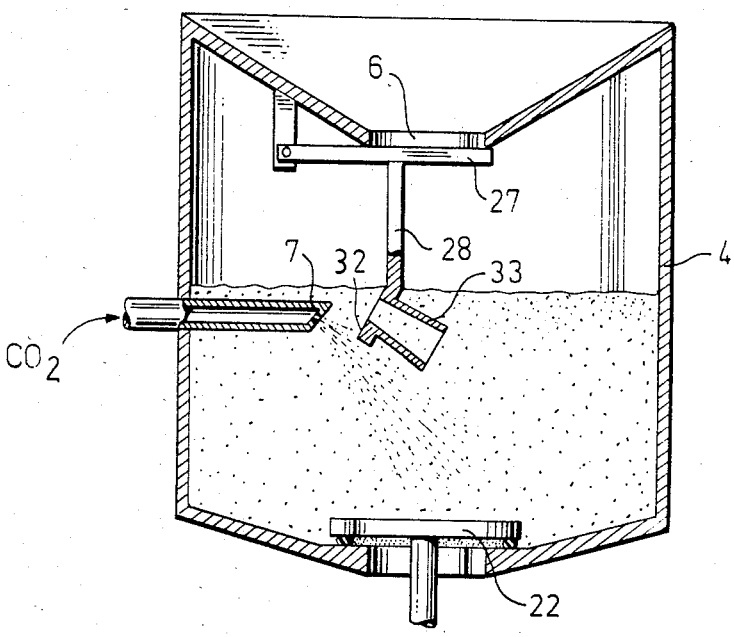

On the other hand, as illustrated in FIG. 4, when the liquid container is filled with liquid to a level above the location of the gas nozzle 7, the pipe section 33 will be filled with liquid. The gas jet will then blow the water out of the pipe section, and in so doing replacement water will be drawn into the pipe section by suction and eduction. The frictional drag effect of such flow of water along the inner surface of the pipe section will initiate the counterclockwise rotation of the arm 28 and valve 27, and after a slight movement away from the nozzle 7 the gas jet will strike the pipe section flange 32 to continue the closing of the valve 27. The valve is finally closed by the increasing gas pressure in the container 4.

Figure 5:
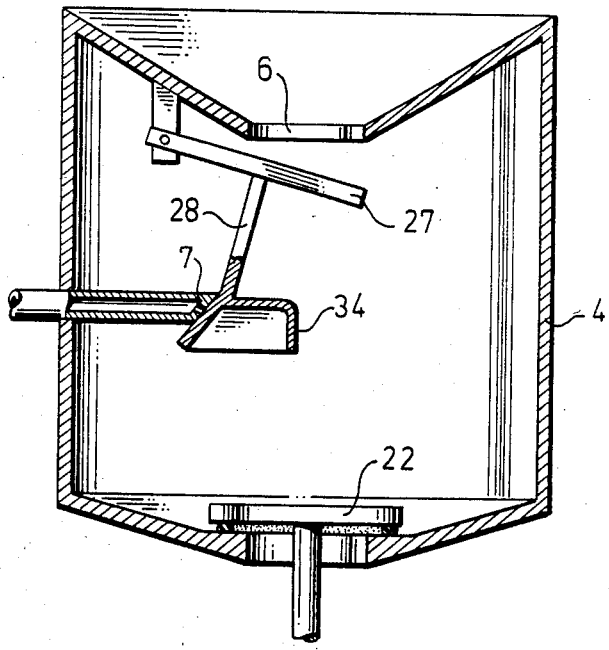
FIGS. 5–7 illustrate schematically and in section a further embodiment of the pressure container.
Figure 6:
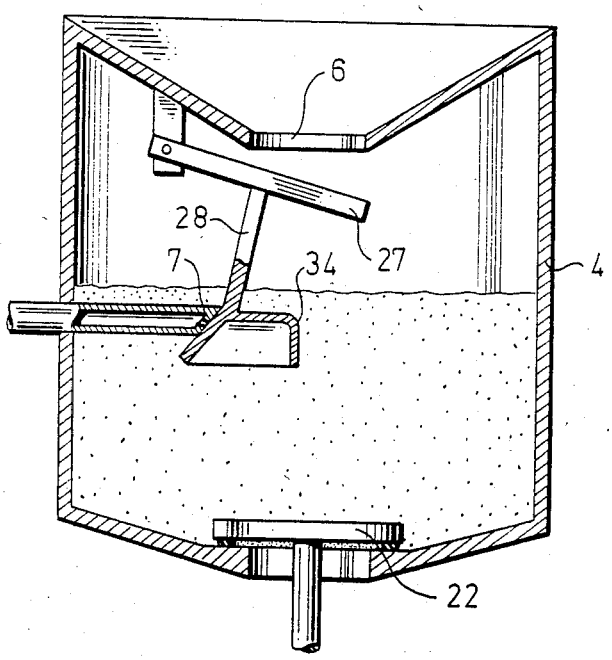
Figure 7:
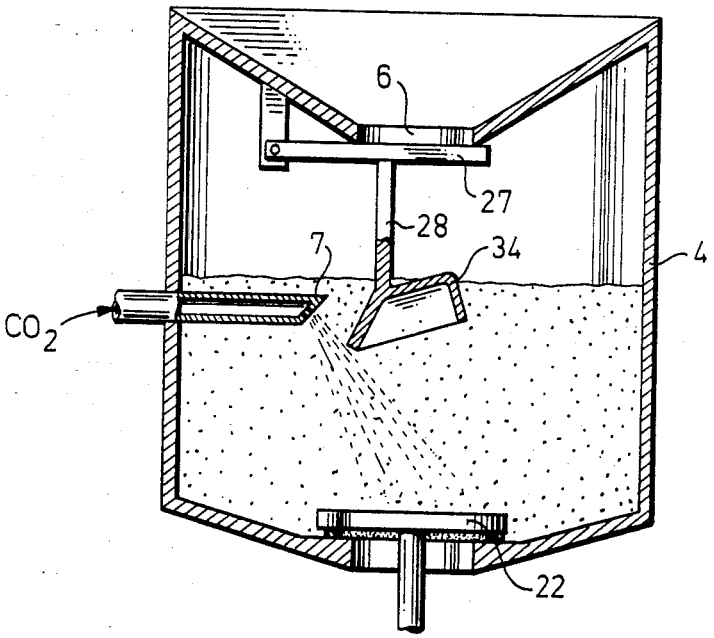

FIG. 5 illustrates schematically an alternative embodiment of the liquid container. As with the former case, the valve 27 cannot be closed until the level of liquid reaches the nozzle 7. In this respect, the actuating arm 28 has a lower part in the form of an inverted cup 34, the weight of said cup being such that the gas jet alone is unable to initiate the closing movement of said valve. When the container 4 is filled with liquid as shown in FIG. 6, however, the air trapped in the cup 34 will provide a lifting force. This force, however, is too small to initiate closing of the valve. The weight and volume of the cup 34 are namely so selected that initiation of the closing movement is not effected until the combination of liquid and gas jet is reached, see FIG. 7.

Figure 8:
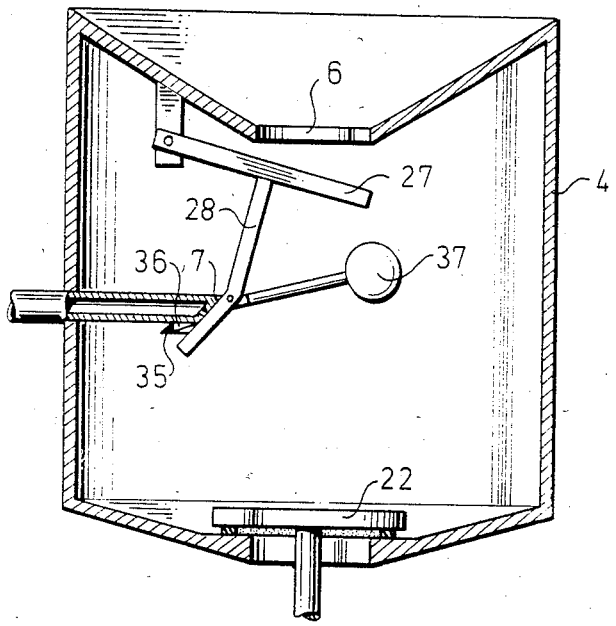
FIGS. 8–10 illustrate schematically and in section another embodiment of the pressure container.
Figure 9:
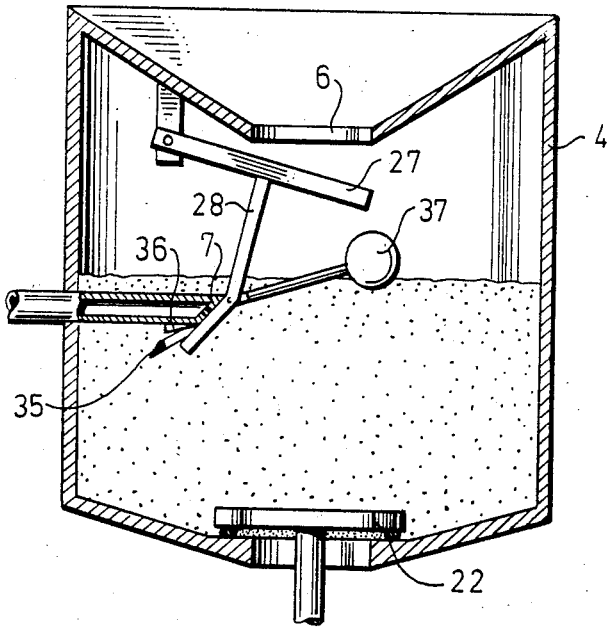
Figure 10:
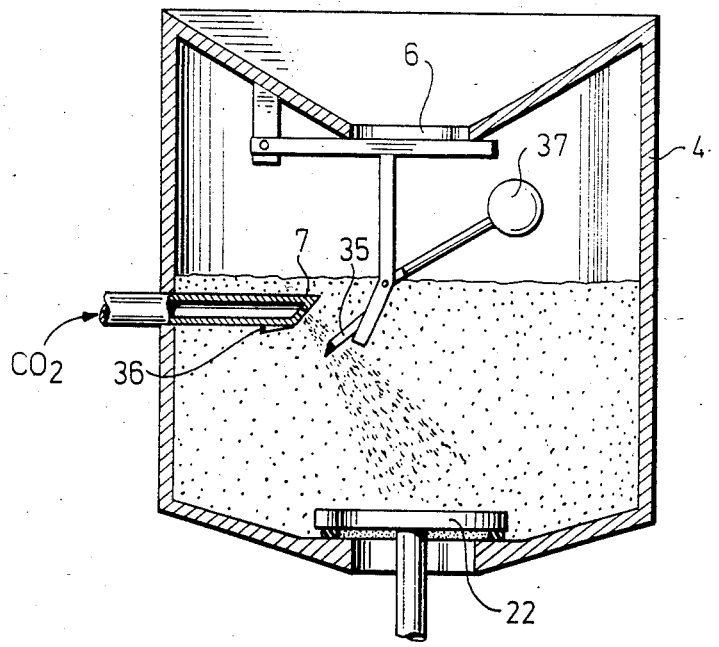

FIG. 8 illustrates another alternative embodiment of a means for closing the valve 27. In this embodiment, the actuating arm 28 is connected to a hook 35 and a bouyant body 37. When the container 4 is empty, the hook 35 is in engagement with a corresponding tab 36 on the gas nozzle 7, and thus prevents the actuating arm 28 from moving. When the level of liquid reaches the bouyant body 37, however, (see FIG. 9) the hook 35 will be released from the tab 36, whereafter closing of the valve can be initiated by means of the gas jet, as shown in FIG. 10.

Although a beverage dispensing apparatus according to the invention has been described with reference to various embodiments thereof, it will be obvious to those skilled in this art that further variations can be made within the scope of the basic concept of the invention, namely closure of the liquid container by means of the pressure of the carbon dioxide charged. The flap valve 27, for example, can be replaced with any suitable type of valve providing a corresponding function. The type and shape of the nozzle 7, its positioning and alignment can be selected as desired. This is also true of the arrangement of the pipe section 33 located in front of the nozzle in FIG. 2.

Other principles for effecting closing of the container in response to the level of liquid therein can also be applied. For example, the container may be provided with an orifice through which gas can escape until said orifice is closed by a body, the movement of which is controlled by the level of liquid. Alternatively, means may be provided which mechanically prevent closure of the filling orifice until the liquid has reached the desired level. In all embodiments, however, further liquid can be supplied subsequent to the pre-determined level being reached, which is of decisive significance in enabling the beverage in question to be prepared in mutually different quantities.

I claim:

1. An apparatus for supplying gas to a liquid in a container (4) having a gas conduit (5) discharging thereinto, said container having arranged in its upper portion a normally open filling orifice (6) through which liquid is introduced into said container, characterized by: normally open closure means (27) disposed proximate but spaced from said orifice and movable in a direction to close said orifice, said closure means being normally biased away from the orifice, and means for automatically initiating movement of the closure means in said direction to close the orifice in response to the supplying of gas to the container.

2. An apparatus according to claim 1, wherein the closing movement of the closure means is initiated at a location spaced from the orifice by the force of the stream of gas charged to the container.

3. An apparatus according to claim 1 or claim 2, wherein said closure means is connected with means (28; 33; 34) located in front of a discharge orifice of the gas conduit in a position to be actuated by the exiting gas stream.

4. An apparatus according to claim 3, wherein the closure means is pivotally suspended and arranged, subsequent to the initiation of said closure by said gas stream, to sealingly close the filling orifice in response to an increasing gas pressure in the container.

5. An apparatus according to claim 3, wherein the means (28; 33; 34) located in front of the discharge orifice of the gas conduit (5) is arranged, when gas is supplied to said container, to enable the initiation of the closure of the closure means (27) only when the container is filled with liquid to a predetermined level.

6. An apparatus according to claim 5, wherein said located means is provided with an orifice (33) through which the gas stream can pass until said orifice is closed by liquid, subsequent to said liquid having reached said predetermined level.

7. An apparatus according to claim 5, wherein the weight of said located means (34) is such that the gas stream is incapable of actuating said located means until a buoyant force of said liquid also acts upon said located means.

8. An apparatus according to claim 5, wherein said located means (28) is immobilized by a mechanical latch (35, 36) when the container is empty; and said latch is arranged to be released by the action of the liquid on a body (37) co-acting with said latch.

9. An apparatus for carbonating water, comprising:

(a) a container (4), (b) a $CO_2$ gas conduit (5) having a discharge end (7) extending into the container, (c) a water supply opening (6) in an upper portion of the container, (d) normally open movable means (27) for closing the opening, (e) means (28) connected to the closing means and extending to a position proximate the gas conduit discharge end for initiating the closure of the closing means and thus the opening in response to the supply of $CO_2$ to the container, and (f) means connected to the initiating means for disabling the closure of the closing means unless the container is filled with water to a predetermined level.

10. An apparatus according to claim 9, wherein the disabling means comprises an open pipe section (33) having one end aligned with the gas conduit discharge end when the closing means is open.

11. An apparatus according to claim 9, wherein the disabling means comprises an inverted buoyant cup member (34).

12. An apparatus according to claim 9, wherein the disabling means comprises means (35, 36) for latching the initiating means to the gas conduit discharge end, and buoyant means (37) for releasing the latching means.

* * * * *